US007812235B2

(12) United States Patent
May

(10) Patent No.: US 7,812,235 B2
(45) Date of Patent: Oct. 12, 2010

(54) MARCHING PERCUSSIONIST PRACTICE PAD WITH STRUCTURE THAT EMULATES A DRUM

(76) Inventor: Randall L May, 2 Trafalgar, Newport Beach, CA (US) 92660-6830

( * ) Notice: Subject to any disclaimer, the term of this patent is extended or adjusted under 35 U.S.C. 154(b) by 0 days.

(21) Appl. No.: 12/358,717

(22) Filed: Jan. 23, 2009

(65) Prior Publication Data

US 2009/0188373 A1 Jul. 30, 2009

Related U.S. Application Data

(60) Provisional application No. 61/062,523, filed on Jan. 25, 2008.

(51) Int. Cl.
*G10D 13/02* (2006.01)

(52) U.S. Cl. ..... 84/411 R; 84/411 P

(58) Field of Classification Search ..... 84/411 R, 84/421, 411 P

See application file for complete search history.

(56) References Cited

U.S. PATENT DOCUMENTS 2,078,004 A 4/1937 Lebow
2,338,816 A 1/1944 Lockhart
2,475,873 A 7/1949 Banta
3,166,970 A 1/1965 Ellman
4,406,207 A * 9/1983 Criscione ..... 84/411 P
4,648,302 A 3/1987 Bozzio
D320,035 S 9/1991 Magruder
D348,476 S 7/1994 O'Connor
D386,780 S 11/1997 Ohno
5,929,354 A 7/1999 Davis
6,239,340 B1 5/2001 Heuerman
D465,510 S 11/2002 Edwards et al.

* cited by examiner

*Primary Examiner*—Kimberly R Lockett
(74) *Attorney, Agent, or Firm*—Kirk A. Buhler; Buhler & Associates

(57) ABSTRACT

Improvements in a drum practice pad are disclosed. The practice pad is intended for use with a mobile or shoulder mounted percussion instrument carrier or with a stand configured for use with a percussion instrument. The practice pad incorporates most or all of the geometry of a drum that is addressed by a player. This geometry includes a portion of the striking surface, and a portion of the drum rim. The sticking surface is adjustable within the portion of the drum rim to match the central playing area and the height of the playing surface to the rim of the drum. The assembly allows for attachment or mounting and use of a practice pad from a third party. The strike location of the practice pad is adjustable to simulate different diameter drums. The incorporation of the drum rim allows players to practice rim shots.

20 Claims, 6 Drawing Sheets

MARCHING PERCUSSIONIST PRACTICE PAD WITH STRUCTURE THAT EMULATES A DRUM

CROSS REFERENCE TO RELATED APPLICATION

This application claims the benefit of Provisional 61/062,523 filed Jan. 25, 2008 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in a drum practice pad. More particularly, the practice pad is for use for a marching percussionist/drummer with a shoulder or mobile mounted carrier. The practice pad emulates a portion of the drum without the weight of the entire drum. The practice pad incorporates a pad that is struck with a standard drum stick and a portion of the drum rim to allow rim shots with the drum stick. The height, location and position of the drum pad are adjustable to closely simulate the playing surface of an actual drum 2. Description of Related Art Including Information Disclosed Under 37 CFR 1.97 and 1.98

Most drum practice pads are designed for use to improve technique, drumming accuracy and speed. Practice pads often consist of flat surface that a drummer strikes with a drum stick, in some cases the practice pad has a raised edge that extends around the outside of the practice pad to simulate the rim of a drum. In a marching band a drummer practices standing, turning, walking, marching moving and possibly running while they continue to play a drum. In this form of practice a drummer must carry the entire weight of a drum while they are practicing both field drills and performance. The load of the drum places a load on the performer that can result in fatigue that will shorten the amount of time that a musician can practice without becoming fatigued. Practice drum pads provide a static playing surface, but none are specifically intended for use by a shoulder supported carrier. Some exemplary examples of flat practice pads are identified herein.

Examples of flat practice pads are found in U.S. Pat. No. 5,929,354 issued Jul. 27, 1999 to Jimmy C. Davis, U.S. Pat. No. D465,510 issued Nov. 12, 2002 to Jason S. Edwards et al, and U.S. Pat. No. D320,035 issued Sep. 17, 1991 to Thomas O. Magruder. These practice pads all disclose a pad that is thin, smaller in size than a drum head and give a use the ability to practice striking that surface of the practice pad. These patents all lack a drum rim to practice rim shots, and are further not mountable onto a stand or shoulder mounted carrier.

Examples of drum practice pads that are worn by a user include U.S. Pat. No. 4,406,207 issued Sep. 27, 1983 to John J. Criscione and U.S. Pat. No. 2,338,816 issued Jan. 11, 1944 to L. M. Lockhart. Both of these two patents disclose securing systems to mount the practice pad onto the leg of a user. In operation these pads are strapped around the leg of the user in a location that is just above the knee. While these practice pads allow a user to practice drumming while they are seated, the practice pad can't be accurately played while the person is walking. The practice pad does not have a rim for practicing rim shots and further does not include provisions for mounting on a stand or shoulder mounted instrument carrier.

Examples of drum practice pads that are mounted on an erected stand include U.S. Pat. No. 5,932,823 issued Aug. 3, 1999 to Malcolm W. Jacobs, U.S. Pat. No. D386,780 issued Nov. 25, 1997 to Masaharm Ohno and U.S. Pat. No. D348,476 issued Jul. 5, 1994 to David O'Conner. These three patents each disclose a practice pad on a fixed erected platform. Some of these patents further disclose a raised rim. While these patents disclose a stand mounted practice pad they are not usable in a mobile environment, and they do not disclose a method for mounting to a mobile or shoulder supported instrument carrier.

What is needed is a practice pad that is designed for use on a mobile or shoulder mounted instrument carrier. The drum pad should simulate the physical features that are addressed by a user including the drum rim and mounting structure for use on the instrument carrier. The practice pad should also be adjustable to simulate drums of different diameters. The proposed application satisfies there requirements with a practice pad that provides these entire user features without the weight of an actual drum.

BRIEF SUMMARY OF THE INVENTION

It is an object of the marching band practice pad with a portion of the rim attached to the practice pad. The rim is a portion of the actual counter hoop of a drum, and can range from the entire circular rim to only a sector of the rim. The inclusion of the rim portion allows a user to practice rim shots on the practice pad without the weight of the drum or the circumference geometry of the drum while practicing technique and marching formation.

It is an object of the marching band practice pad to include a practice pad that allows a user to practice striking the center of the drum while they are marching without the benefit of looking down at the practice pad/drum. The practice pad may exist concentric with the rim and occupies only a portion of the center of the drum. The practice pad can exist as small as a few inches in diameter to the full interior size of the rim. The position of the practice pad is also adjustable within the rim to simulate drums of different diameter.

It is an object of the structure that emulates a drum is to accommodate a practice pad from a third party. The user may have a practice pad that they prefer due to sound, responsiveness or feel, and the user can mount their preferred practice pad to the structure, adjust the position and height of the pad to the desired location to emulate the geometry of the drum. These third party practice pads can also include electronic practice pads that a user may have.

It is another object of the marching band practice pad is to make the practice pad adjustable to simulate drums of different diameters. This adjustment allows one practice pad to be used by a variety of different performers with some simple adjustment. The adjustments include the height of the playing surface and distance from the rim. In addition the height of the practice pad below the rim is adjustable to emulate the distance from the playing surface to the rim as it would exist on a complete drum.

It is another object of the marching band practice pad is to have an extruded anvil portion that where the practice pad is mounted. The extruded anvil portion is movable on the shank of the structure to move the practice pad closer or further from the user. The extruded anvil can be rotated on the shank to provide several different densities of the practice pad playing surfaces.

It is another object of the marching band practice pad to provide connection means for mounting the practice pad onto a musical instrument carrier. The mounting mechanism allows quick loading and unloading of the practice pad onto the carrier. The connection mechanism mimics the connection mechanism for an actual drum and allows a user to easily switch between the practice pad and an actual drum without the use of tools and without deviating from the height, angle or position of an actual drum.

It is another object of the marching band practice pad to provide a practice pad that is configurable to an array of drums and to an upright bass drum.

It is another object of the marching band practice pad to provide a practice pad that is transferable from a mobile or shoulder mounted carrier to a ground mounted stand or stadium hardware.

It is still another object of the marching band practice pad to provide a practice pad without the weight of the remainder of the drum. The reduced weight relieves the user from carrying the cantilevered weight of a drum while they practice movement and technique.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
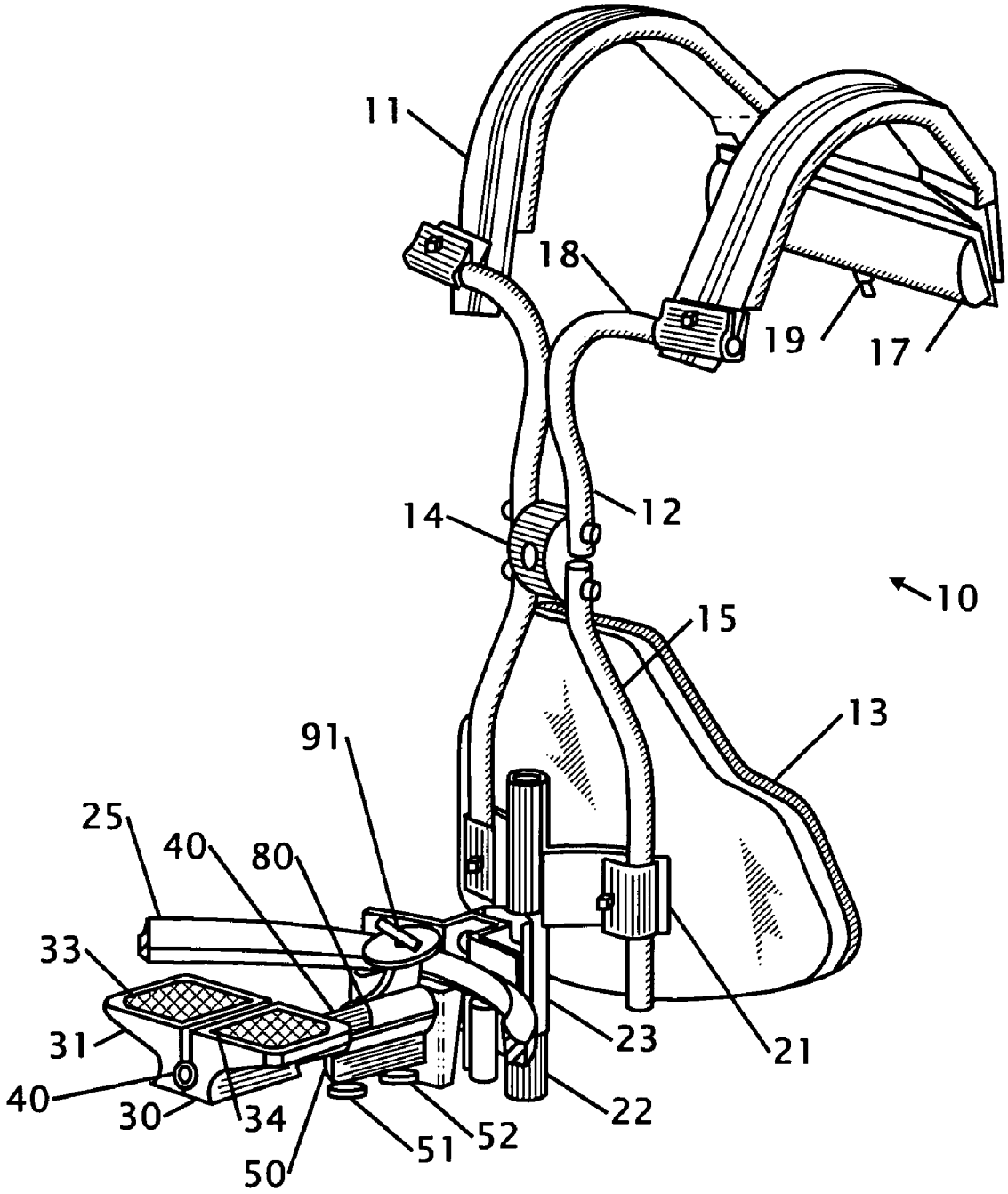
FIG. 1 shows an isometric view of the practice pad mounted on one configuration of an instrument carrier without the use of J-Rod/tubes.

FIG. 1 shows an isometric view of the practice pad mounted on one configuration of an instrument carrier 10 without the use of J-Rod/tubes. The instrument carrier 10 is designed for use with a percussion instrument such as a drum. The components of the practice pad mount to the instrument carrier 10 in a similar manner as a percussion instrument is mounted. The ability to interchange the drum and the practice pad allows a user to quickly change the instrument, or practice pad, being played. The percussion instrument carrier 10 in this figure is described in prior patents from the same inventor that have priority to U.S. Pat. No. 5,691,492 and published patent applications US-2006-0137506. The instrument carrier has mobile or shoulder supporting member 11 that rest on the shoulders of a user.

The shoulder members 11 may be identified with various names such as shoulder straps, shoulder hooks, shoulder bars or other names but all include rigid or semi rigid components that transfers the load of the carrier, and any mounted instrument, to the user. The shoulder supporting members may be considered in a number of configurations. Four contemplated configurations of the shoulder supporting members include first, two separate straps that connect to a back member and a separate front member. Second, as a combination of shoulder straps combined with the front member in a U, V, T or yoke as a single unit configuration as is shown and described in the inventors patent application US-2005-0183565. Third as a combination of the shoulder straps combined with the back member as a single unit. Fourth as a combination of the shoulder straps, front member and back member as a single unit. Obvious variations to these four combinations are also contemplated that include combinations of one shoulder strap with the back member, one shoulder strap with the front member, and one shoulder strap with the back and the front member. In addition, splitting the shoulder strap, back member and or the front member into numerous pieces are also contemplated.

In FIG. 1 the back member 17 spans across the ends of the shoulder straps 11. The back member 17 may be welded, fastened, secured, or removably secured to the shoulder straps 11. The back member 17 may also be adjustable to different widths to accommodate different users. In the embodiment shown the back member 17 includes a fillable bladder that is adjustable through a nipple 19. The air fillable bladder is described in a prior filed application by the inventor and published as US 2006-0186151.

The shoulder straps 11 are connected in the front of the carrier with hardware that connects the shoulder straps to drum securing hardware. In the embodiment shown, tubular members 18 join with tubular member 12 where they are further secured to a hinging or pivoting mechanism 14. The hinging or pivoting mechanism is described in a prior issued patent by the inventor and is herein identified by U.S. Pat. No. 7,166,790. From the hinging or pivoting mechanism 14 tubular members 15 connect with the abdomen or belly plate 13.

The abdomen or belly plate 13 rests against the abdomen, belly or stomach of a user. The abdomen or belly plate can be padded to cushion the plate to aid in comfort. A bifurcated structure 21 is connected to the abdomen or belly plate 13. The bifurcated structure 21 is connected to a single or mono post 22 with a dovetail connection that allows the post 22 to slide on the bifurcated structure 21 and drum securing hardware 23 in a bypass arrangement. The drum securing hardware allows interchangeability of a percussion instrument (drum) or a practice pad. An exploded view of the components that secure the drum or practice pad are shown and described in more detail in FIG. 3.

For a basic understanding of the practice pad, FIG. 1 shows the components as a counter hoop 25 and bead head pad (s) 33 and 34. The practice pad has a number of different adjustments to make the practice pad height, diameter and feel identical to an actual drum without the weight of a drum. The adjustments include a T-bolt 91 that is use to slide the adjustable clamp 80 on the fluted adjustment tube 40 to set the diameter of the counter hoop 25. Screws 51 and 52 are threaded through sliding collar 50 to adjust the position of the fluted adjustable tube 40. A pair of anvil extrusions 30 and 31 is slidably secured to the fluted adjustable tube 40. On the top of each anvil extrusion a bead practice pad 33 and 34 is located.

Figure 9:
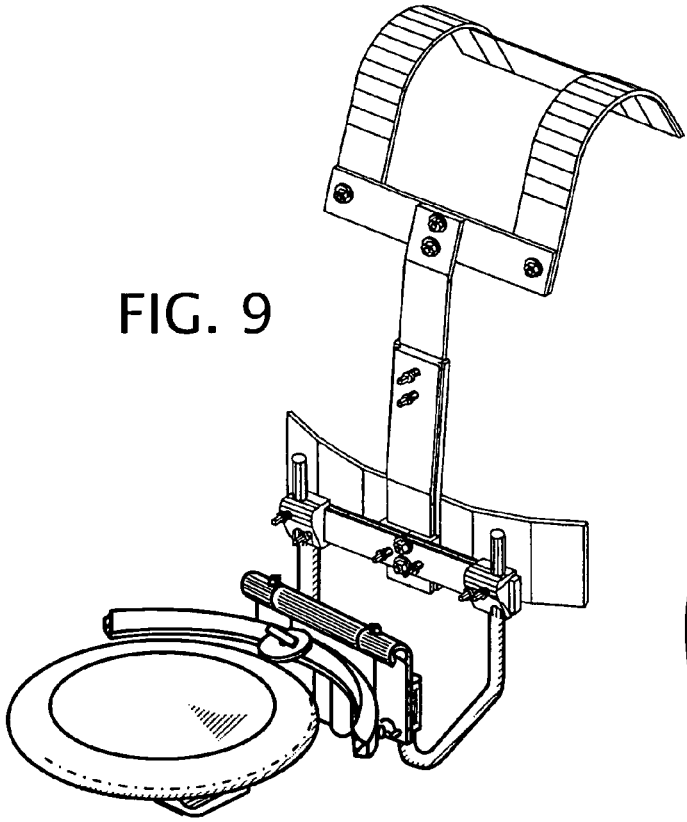
FIG. 9 shows the drum pad mounted on a T-Bar type carrier.
Figure 10:
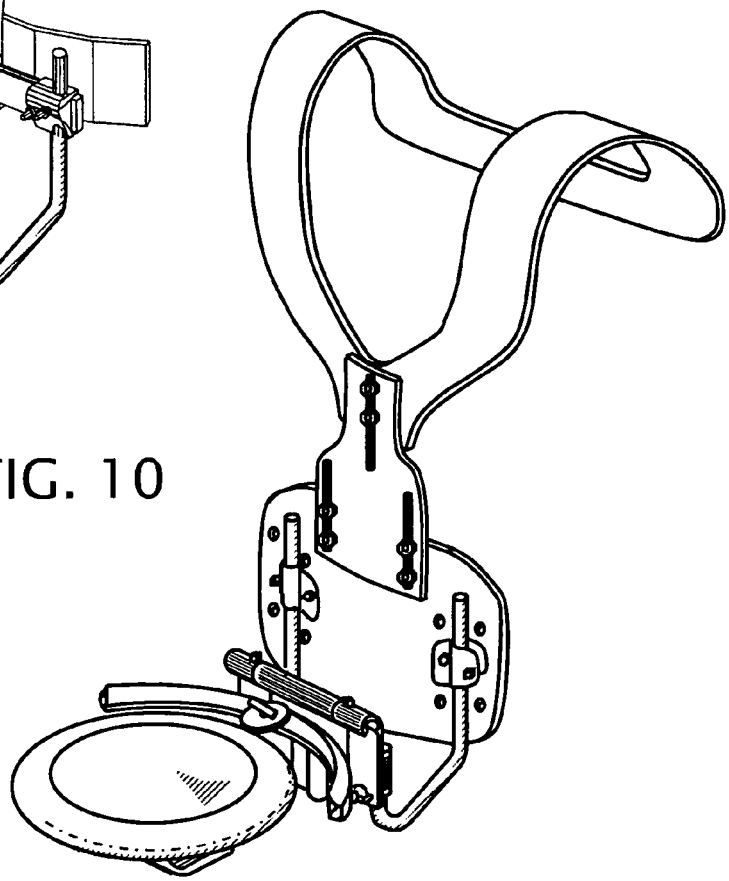
FIG. 10 shows the drum pad mounted on a vest type adjustable carrier.

The carrier shown in most of the figures is made from tubular material. This is only one contemplated type of carrier, and other types of percussion instrument carrier construction methods are contemplated including but not limited to T-Bar, vest, monolithic and others. Some examples of these types of percussion instrument carriers are shown in FIGS. 9 and 10.

Figure 2:
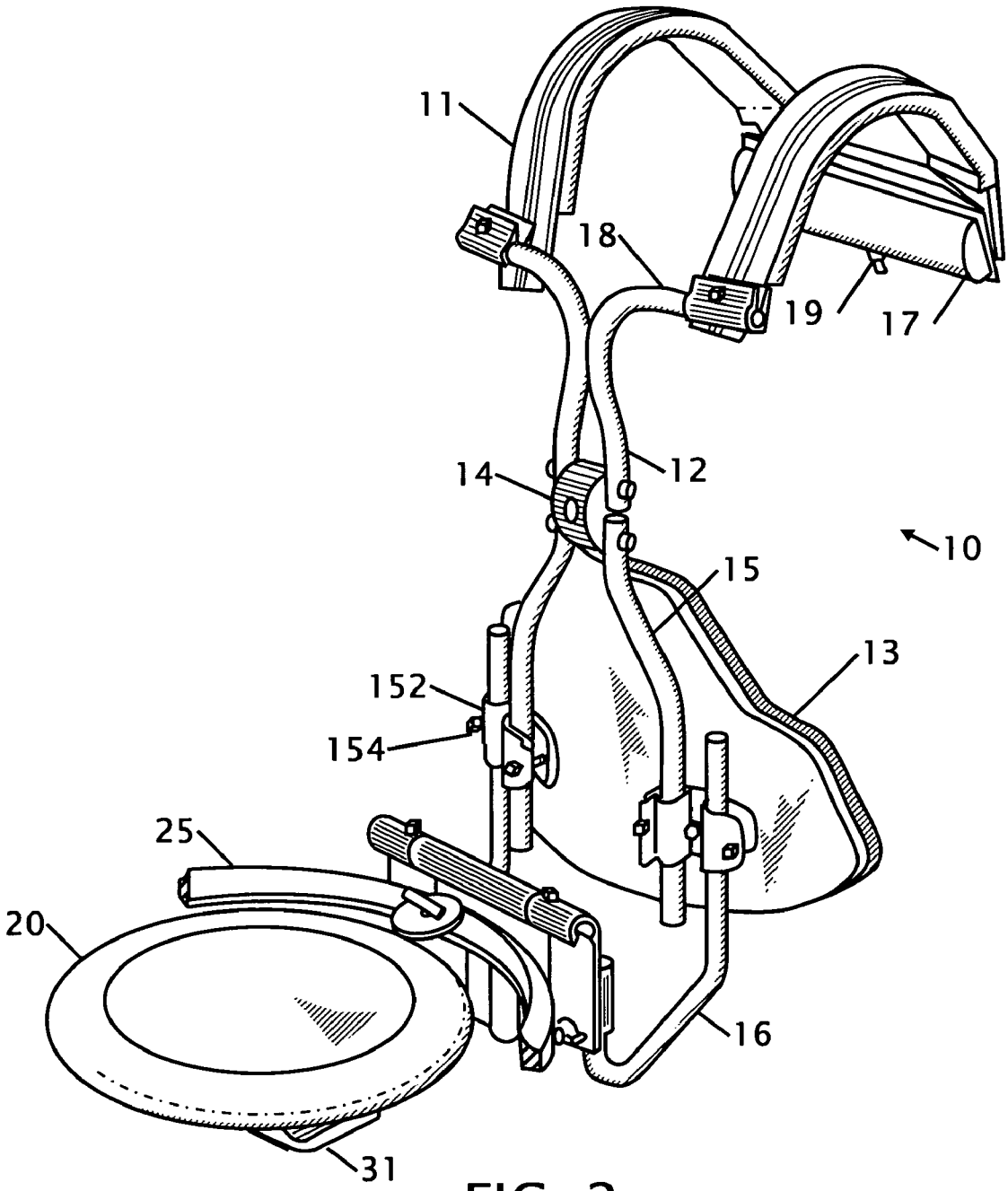
FIG. 2 shows an isometric view of the practice pad mounted on a second configuration of an instrument carrier with the use of J-Rod/tubes.

FIG. 2 shows an isometric view of the practice pad mounted on a second configuration of an instrument carrier 10 with the use of J-Rod/tubes. The instrument carrier 10 is similar to the instrument carrier 10 that was shown and described in FIG. 1. It also includes shoulder straps 11 and an optional back member 17, and a filling nipple 19 for filling an air bladder. The shoulder straps 11 connect to the front of the carrier with tubing 18 that connects into vertical tubes 12 and then into a hinging or pivoting mechanism 14. The shoulder straps 11 and the upper portions of the carrier (tubes 18 and 12 are shown with individual pieces formed from rods or tubes, but these components could equivalently be formed from a single homogeneous material as a monolithic structure. In addition the hinging or pivoting mechanism 14 could be a vertically adjustable component that alters the distance between the upper portion of the carrier and the drum attaching hardware.

From the hinging or pivoting mechanism 14 tubular members 15 join into the abdomen or belly plate 13 with tube clamps 152 that clamp and secure the tubes 15. A second set of tube clamps secures the J-Rod/tubes 16. Screws 154 have a head configured to equate to a drum adjusting bolt to minimize the number of tools required to adjust the instrument carrier 10. In this figure a practice pad 20 is shown mounted to the anvil extrusion 31. The practice pad 20 can be supplied by the manufacturer or the anvil extrusion can accept practice pads that a user may currently be using. The practice pad 20 may also be an electric drum pad and include a power supply and speaker to simulate a drum sound when it is struck. The counter hoop 25 is shown with the practice pad. The counter hoop is shown as an arc segment instead of a complete counter hoop. The inclusion of the counter hoop 25 allows a performer to perform rim shots that they may be required to perform. In the preferred embodiment the counter hoop 25 is an arc segment of between 90 and 180 degrees and in the configuration shown the arc angle is 120 degrees. It is also contemplated that a complete counter hoop 25 could be used as well as two separate sections of counter hoops located on each side of the hardware that secures the practice pad to the instrument carrier.

Various size practice pads 20 and bead pads (33 and 34 from FIG. 1) can be secured to the anvil extrusions to simulate different diameter drums and surface textures. One method of securing the practice pad is with screws. In other contemplated securing method, magnets are used to allow the practice pad 20 to be solidly secured and also allow the practice pad 20 to be quickly removed.

Figure 3:
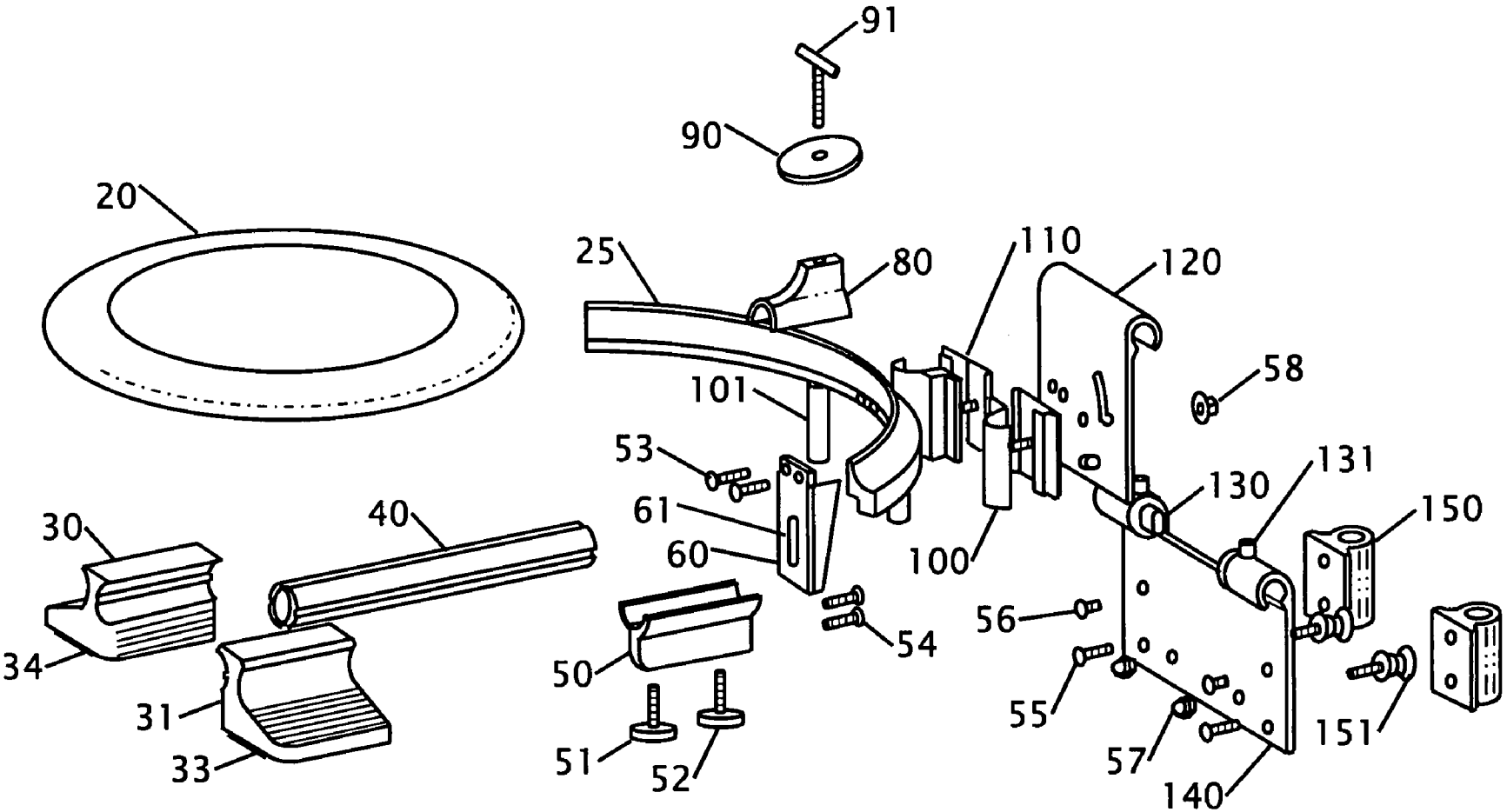
FIG. 3 is an exploded view showing the components of the practice pad.

FIG. 3 is an exploded view showing the components of the practice pad. Starting in the lower right corner of this view the J-Rod/tube receivers 150 are shown. These receivers slide onto the J-Rod/tubes shown in FIG. 2. The J-Rod/tube receivers 150 are secured onto the stationary hinge 140 with screws 55 and 56 or the like. The rotatable hinge 120 is slid onto elongated nipple(s) 130 located on the stationary hinge 140. A securing screw 131 prevents rotation of the hinge. The rotatable hinge 120 is allowed to hinge on the stationary hinge 140. The angle of the rotatable hinge 120 on the stationary hinge 140 is adjustable with angle adjustment screws 151 that are screwed into acorn nuts 57 that push on the back of the rotatable hinge 120.

Tube clamps 100 and 110 are secured to the rotatable hinge with screws or the like and nut 58 holds the tube clamps in place on the rotatable hinge 120. Note that the rotatable hinge can have slots to allow for angular adjustment of the tube clamp(s) 100 and or 110. Rods or tubes 101 are secured to the counter hoop 25 and the rods or drum tubes 101 are clamped into the tube clamps 100 and 110. Vertical adjustment hardware 60 is secured to the counter hoop 25 with screws 53 or the like. The vertical adjustment hardware 60 has a slot 61 where the sliding collar 50 is secured with screws 54 or the like. The sliding collar 50 is configured with dovetail grooves and edges for engagement with the fluted adjustment tube 40.

The sliding collar is held in position with screws 54. The thumb screws 51 and 52 allow for quick and easy adjustment for the location of the fluted adjustment tube. An adjustable clamp 80 also has dovetail grooves and edges to secure the adjustable clamp on the fluted adjustment tube 40. The adjustable clamp 80 is secured in position on the fluted adjustment tube 40 with a T-bolt 91 that passes through a washer 90.

The practice pad 20 is shown with above the anvil extrusions 30, 31 as it would be mounted in FIG. 2. The anvil extrusions 31 and 31 have fluted edges and grooves that engage onto the fluted adjustment tube 40. In FIG. 1 the anvil extrusions 30, 31 are mounted in an inverted orientation where the bead practice pads 33 and 34 are shown on top. The anvil extrusions 30, 31 can be inverted by sliding them off the fluted adjustment tube 40 or by removal of the fluted tube turning the tube 40 or the anvil extrusions 180 degrees and sliding them back into position.

The position of the sliding collar 50, fluted adjustment tube 40, adjustable clamp 80, anvil extrusions 30, 31, and the practice pad 20 are all quickly and easily adjustable to set the location of the practice pad in a vertical and horizontal position relative to the instrument carrier and the counter hoop 25.

Figure 4:
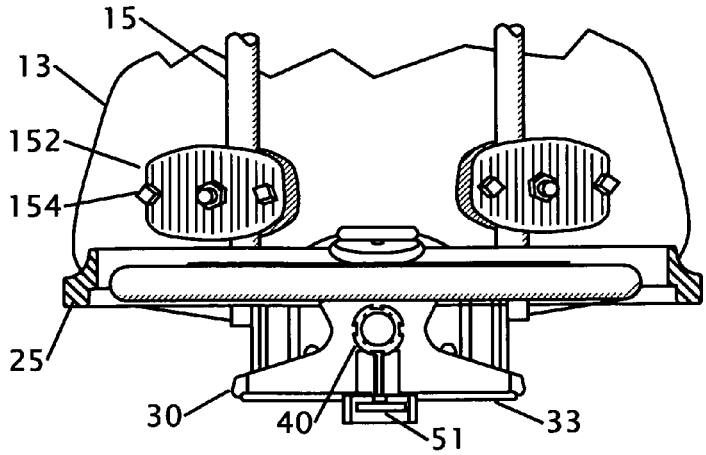
FIG. 4 shows a front view of the practice pad mounted on an instrument carrier with J-Rod/tubes.
Figure 5:
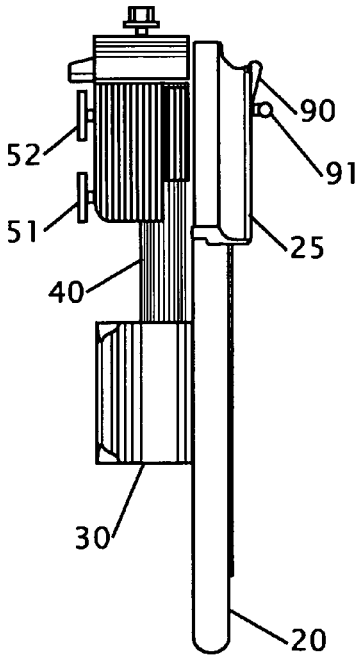
FIG. 5 shows a side view of the practice pad and structure.
Figure 6:
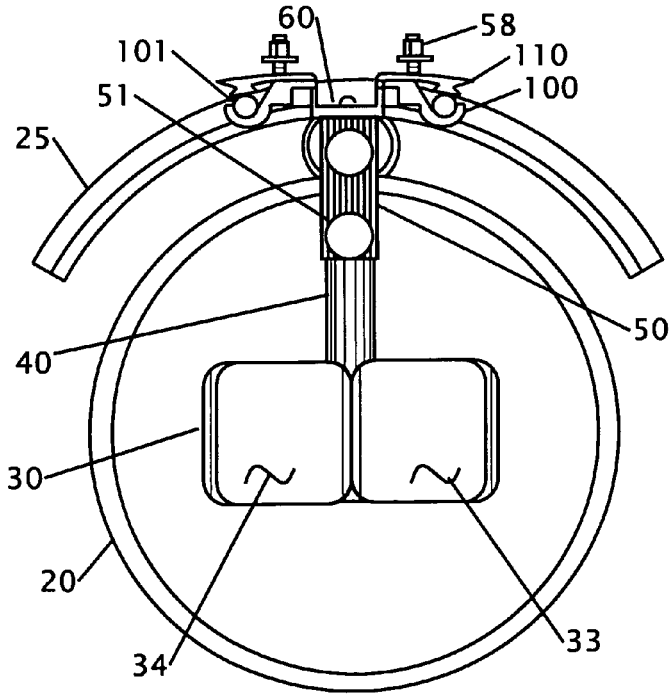
FIG. 6 shows a bottom view of the practice pad and structure.

FIG. 4 shows a front view of the practice pad mounted on an instrument carrier with J-Rod/tubes. FIG. 5 shows a side view of the practice pad. FIG. 6 shows a bottom view of the practice pad. These three views provide a greater clarity of the assembled practice pad on an instrument carrier. From FIG. 4 the abdomen or belly plate 13 is shown connected to tubular members 15. The clamps 152 hold the tube 15 onto the abdomen or belly plate 13 with screws or bolts 154. The J-Rod/tubes and or the mounting hardware from FIG. 1 and FIG. 2 have been removed in these three figures for clarity. From FIG. 6 the rods or tubes 101 is shown inside tube clamps 100 and 110 with the nut 58 that is used to clamp onto the rotatable hinge (120 in FIG. 3). The fluted adjustment tube 40 is shown extending from the sliding collar 50 and the vertical adjustment hardware 60. The locking thumbscrews 51 and 52 are shown extending from the sliding collar 50 in the figures. The washer 90 and the T-handle bolt 91 is secured to the adjustable clamp 80 (not visible). The counter hoop 25 is visible in all the figures extending partially around the practice pad 20. From FIG. 6 the anvil extrusions 30 (31) are shown with the bead practice pad 33 and 34.

Figure 7:
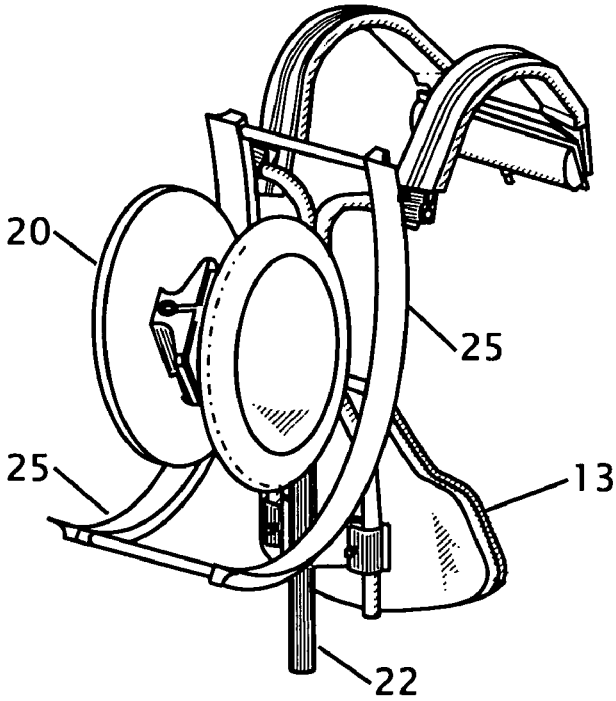
FIG. 7 shows a vertically mounted drum pad.

FIG. 7 shows a vertically mounted drum pad. This embodiment uses the mobile or shoulder mounted carrier from FIG. 1 with an upright portion of a drum to form the drum pad(s) 20. The mounting structure for the upright drum pads 20 is described in a prior patent application by the inventor and is herein identified by the inventor's U.S. Pat. No. 7,326,842. The vertically mounted practice pad configuration two practice pads 20 are placed on opposite sides of the two counter hoops 25. The counter hoops 25 are secured to the carrier at or near the location where the shoulder straps are connected, and the lower portion of the upright drum practice pads are positioned on the post 22 that is secured to the abdomen or belly plate 13.

Figure 8:
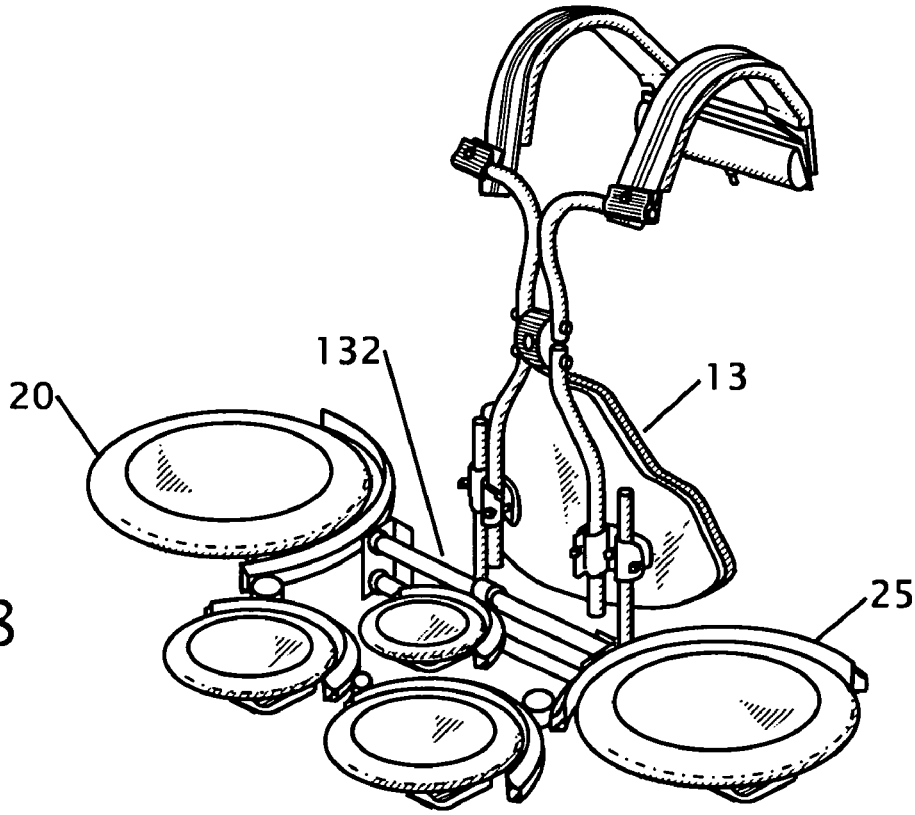
FIG. 8 shows a drum array of drum pads.

FIG. 8 shows a drum array of drum pads. This embodiment uses the mobile or shoulder mounted carrier from FIG. 2 with a drum pad array using a number of drum pads 20 with each drum pad 20 in a portion of a counter hoop 25. It should be noted that each counter hoop 25 and each practice pad 20 may have the same or different diameters. The mounting structure for the drum array is connected to the abdomen or belly plate of the carrier 13 on a tenor rail 132. The securing of the array of drums to an instrument carrier is shown and described in a prior patent application by the inventor and is herein identified by published application US-2005-0103183.

FIG. 9 shows the drum pad mounted on a T-Bar type carrier and FIG. 10 shows the drum pad mounted on a vest type adjustable carrier. These figures show that the practice pad is can be used with a variety of different type and configuration of instrument carriers and is not limited for use on a tubular constructed carrier.

Thus, specific embodiments of a marching band practice pad with structure that emulates a drum have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A practice drum pad comprising:

a securing means for temporally securing a drum pad to a shoulder supported instrument carrier or a tripod stand where said securing is by vertically lowering said securing means onto said carrier or tripod stand;

said securing means having an arced sector of a counter hoop wherein said counter hoop sector and or said securing means can be raised and lowered relative to said shoulder supported instrument carrier;

said securing means having a drum pad that is positional in an up and down and or towards and away relationship relative to said securing means and said counter hoop sector.

2. The practice drum pad according to claim 1 that further includes securing means for a third party practice pad.

3. The practice drum pad according to claim 1 where said towards and away positioning is with a fluted tube secured to said securing means that provides anti-rotation of said practice pad when said practice pad is being moved in said towards or away position.

4. The practice drum pad according to claim 1 wherein said counter hoop is changeable to provide counter hoops of different rim radii.

5. The practice drum pad according to claim 1 wherein said securing means includes an elongated member extending from said securing means.

6. The practice drum pad according to claim 5 wherein said practice pad is formed from two halves that are securable onto said elongated member.

7. The practice drum pad according to claim 1 wherein said securing means is configured for securing said practice drum pad onto J rods.

8. The practice drum pad according to claim 1 wherein said securing means is configure for securing said practice pad onto a vertically linear track or tube.

9. The practice drum pad according to claim 1 wherein said securing means further is configured to rotate said practice pad on said securing means.

10. The practice drum pad according to claim 1 wherein said securing means provides for securing more than one practice pad in an array and or in an opposite pad abutted orientation.

11. A practice drum pad comprising:

a securing means for temporally securing a drum pad to a shoulder supported instrument carrier or a tripod stand;

said securing means having a counter hoop or an arced sector of a counter hoop, and said securing means having a drum pad that is positional in an up and down and or towards and away relationship with said securing means.

12. The practice drum pad according to claim 11 that further includes securing means for a third party practice pad.

13. The practice drum pad according to claim 11 where said towards and away positioning is with a fluted tube secured to said securing means that provides anti-rotation of said practice pad when said practice pad is being moved in said towards or away position.

14. The practice drum pad according to claim 11 wherein said counter hoop is changeable to provide counter hoops of different rim radii.

15. The practice drum pad according to claim 11 wherein said securing means includes an elongated member extending from said securing means.

16. The practice drum pad according to claim 15 wherein said practice pad is formed from two halves that are securable onto said elongated member.

17. The practice drum pad according to claim 11 wherein said securing means is configured for securing said practice drum pad onto J rods.

18. The practice drum pad according to claim 11 wherein said securing means is configure for securing said practice pad onto a vertically linear track or tube.

19. The practice drum pad according to claim 11 wherein said securing means further is configured to rotate said practice pad on said securing means.

20. The practice drum pad according to claim 11 wherein said securing means provides for securing more than one practice pad in an array and or in an opposite pad abutted orientation.

* * * * *